US009273861B2

(12) United States Patent
Ghiu et al.

(10) Patent No.: US 9,273,861 B2
(45) **Date of Patent: *Mar. 1, 2016**

(54) THERMOSYPHON LIGHT ENGINE AND LUMINAIRE INCLUDING SAME

(71) Applicants: Camil-Daniel Ghiu, Danvers, MA (US); Napoli Oza, Calgary (CA); Shaun P. Montana, Medway, MA (US)

(72) Inventors: Camil-Daniel Ghiu, Danvers, MA (US); Napoli Oza, Calgary (CA); Shaun P. Montana, Medway, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 27 days.

This patent is subject to a terminal disclaimer.

(21) Appl. No.: 14/080,415

(22) Filed: Nov. 14, 2013

(65) Prior Publication Data

US 2014/0071688 A1 Mar. 13, 2014

Related U.S. Application Data

(63) Continuation of application No. 13/100,294, filed on May 3, 2011, now Pat. No. 8,602,590.

(60) Provisional application No. 61/330,567, filed on May 3, 2010.

(51) Int. Cl.
*F21V 1/00* (2006.01)
*F21V 29/00* (2015.01)
(Continued)

(52) U.S. Cl.
CPC ..... *F21V 29/006* (2013.01); *F21V 29/56* (2015.01); *F21S 8/06* (2013.01); *F21V 5/045* (2013.01);
(Continued)

(58) Field of Classification Search
CPC ..... F21V 29/70; F21V 29/004; F21V 29/006; F21V 29/56
USPC ..... 362/235, 294
See application file for complete search history.

(56) References Cited

U.S. PATENT DOCUMENTS 6,746,295 B2 * 6/2004 Sorg ..... 445/24
7,946,737 B2 * 5/2011 Liu ..... 362/373
(Continued)

FOREIGN PATENT DOCUMENTS

CN 101207112 A 6/2008
CN 201255387 Y 6/2009
(Continued)

OTHER PUBLICATIONS

Eric Prevot, Supplementary European Search Report for EP 11 77 8221.9, Mar. 26, 2015, pp. 1-7, European Patent Office, The Hague, The Netherlands.

*Primary Examiner* — Evan Dzierzynski
(74) *Attorney, Agent, or Firm* — Shaun P. Montana

(57) ABSTRACT

A thermosyphon light engine and luminaire including the same are provided. The light engine includes a condenser, an evaporation chamber, and a connecting element therebetween. The condenser returns a gaseous substance located therein to a liquid substance. The evaporation chamber includes a solid state light source, a working liquid, and an optical element that beam shapes light emitted by the at least one solid state light source. The solid state light source is immersed in the working liquid, such that heat generated by the solid state light source changes the working liquid into a gaseous substance. The gaseous substance travels through the connecting element to the condenser, which returns the gaseous substance to a liquid substance. The liquid substance then travels through the connecting element back to the evaporation chamber.

16 Claims, 6 Drawing Sheets

(51) Int. Cl.

| | |
|---|---|
| ***F21V 29/56*** | (2015.01) |
| *F21S 8/06* | (2006.01) |
| *F21V 5/04* | (2006.01) |
| *F21V 13/04* | (2006.01) |
| *F21Y 101/02* | (2006.01) |
| *F21Y 113/02* | (2006.01) |
| *F21V 29/58* | (2015.01) |

(52) U.S. Cl.
CPC ..... *F21V 13/04* (2013.01); *F21V 29/58* (2015.01); *F21Y 2101/02* (2013.01); *F21Y 2113/02* (2013.01)

(56) References Cited

U.S. PATENT DOCUMENTS

2004/0264192 A1* 12/2004 Nagata et al. ..... 362/267
2005/0082158 A1* 4/2005 Wenger ..... 202/155
2005/0168990 A1* 8/2005 Nagata ..... F21V 29/30 362/294
2007/0189012 A1* 8/2007 Huang et al. ..... 362/294
2008/0205062 A1* 8/2008 Dahm et al. ..... 362/294
2009/0001372 A1* 1/2009 Arik ..... C09K 5/10 257/58
2009/0126905 A1* 5/2009 Dinh ..... 165/80.3
2009/0213613 A1 8/2009 Mitic et al.
2011/0261563 A1* 10/2011 Li ..... 362/235

FOREIGN PATENT DOCUMENTS

| | | | |
|---|---|---|---|
| CN | 101526202 | A | 9/2009 |
| CN | 201335345 | Y | 10/2009 |
| DE | 10 2007 054 039 | A1 | 3/2009 |
| EP | 1 475 846 | A2 | 11/2004 |
| JP | 2005085810 | A | 3/2005 |

* cited by examiner

THERMOSYPHON LIGHT ENGINE AND LUMINAIRE INCLUDING SAME

CROSS-REFERENCE TO RELATED APPLICATIONS

The present application is a continuation of, and claims priority to, U.S. patent application Ser. No. 13/100,294, filed May 3, 2011, now U.S. Pat. No. 8,602,590, which claims priority of U.S. Provisional Patent Application No. 61/330,567, filed May 3, 2010, entitled "Thermosyphon Light Engine" and naming Camil-Daniel Ghiu and Napoli Oza as inventors, the entire contents of both of which are hereby incorporated by reference.

TECHNICAL FIELD

The present invention relates to lighting, and more specifically, to light engines and luminaire incorporating one or more active cooling elements.

BACKGROUND

Solid state light sources offer tremendous advantages over conventional lighting technologies. Of course, some of those advantages come at a cost. One cost of using solid state light sources is that solid state light sources generate heat, sometimes tremendous amounts of heat. Typically, lamps and luminaires that use solid state light sources include thermal management systems, such as but not limited to metal heat sinks. These metal heat sinks are typically large and heavy, including a number of fins to increase surface area and thus dissipate more heat. The larger the heat sink, the more heat that is able to be dissipated, and the more solid state light sources and/or the higher power solid state light sources are able to be used in the lamp or luminaire. Simultaneously, the larger the heat sink, the harder it is to fit the heat sink in a more traditionally sized lamp profile (e.g., a classic A19 Edison light bulb) and/or a more traditionally sized luminaire space (e.g., a six-inch ceiling can).

Alternatives to using a metal heat sink to dissipate heat generated by solid state light sources include thermal management systems based on active cooling elements (e.g., small fans that circulate air through the lamp/luminaire) and thermal management systems based on one or more cooling liquids. In the case of a cooling liquid, the liquid may be passed over or around the solid state light sources, gathering heat, and then, in an active system incorporating a pump or similar device, taken away and cooled, and then returned. Alternatively, the cooling liquid may be heated and evaporated, and then condensed, as in a conventional thermosyphon.

SUMMARY

Embodiments described herein provide a new use for a cooling element that incorporates a liquid, such as a thermosyphon. Embodiments described herein provide a thermosyphon light engine that (i) cools one or more solid state light sources, such as but not limited to light emitting diodes (LEDs), organic LEDs (OLEDs), PLEDs, and the like, including combinations thereof, and (ii) helps control and redirect light emitted by the one or more solid state light sources. Further embodiments apply the thermosyphon light engine to luminaires, where the thermosyphon light engine cools not only one or more solid state light sources but also other heat-generating elements of the luminaire (e.g., a power source).

In an embodiment, there is provided a light engine. The light engine includes: a condenser, wherein the condenser returns a gaseous substance located therein to a liquid substance; an evaporation chamber, wherein the evaporation chamber includes: at least one solid state light source that emits light and generates heat upon activation; a working liquid into which at least a portion of the solid state light source is immersed, wherein the working liquid is capable of being changed into a gaseous substance upon the application of heat to the working liquid; and an optical element, wherein the optical element beam shapes light emitted by the at least one solid state light source; and at least one connecting element that joins the condenser to the evaporation chamber, such that when the at least one solid state light source in the evaporation chamber generates heat, a portion of the working liquid evaporates, becoming a gaseous substance, wherein the gaseous substance travels through the at least one connecting element to the condenser, and upon being returned to a liquid substance, wherein the liquid substance travels through the at least one connecting element back to the evaporation chamber.

In a related embodiment, the optical element and the at least one solid state light source may be correspondingly shaped so that the at least one solid state light source rests adjacent to the optical element on an interior surface of the evaporation chamber. In another related embodiment, the evaporation chamber may further include: a support element, wherein the support element may hold the at least one solid state light source in a particular position within the evaporation chamber. In a further related embodiment, the support element may hold the at least one solid state light source in a particular position within the evaporation chamber when the at least one solid state light source is immersed within the working liquid.

In another related embodiment, the evaporation chamber may include a wall, the wall having a first portion and a second portion, wherein the optical element is formed in the first portion of the wall, and wherein the second portion of the wall is shaped to enhance the directional effects of the optical element. In yet another related embodiment, the evaporation chamber may be shaped to include an interior portion and an exterior portion, wherein the interior portion includes the at least one solid state light source, the working liquid, and the optical element, and wherein the exterior portion includes a reflector.

In still another related embodiment, the evaporation chamber may include a plurality of sub-chambers, wherein each sub-chamber in the plurality of sub-chambers may include a solid state light source, a working liquid, and an optical element. In a further related embodiment, each sub-chamber in the plurality of sub-chambers may be shaped to achieve a particular optical effect in combination with the optical element of that sub-chamber. In another further related embodiment, a first sub-chamber in the plurality of sub-chambers may be fixed in a particular direction relative to a second sub-chamber in the plurality of sub-chambers, such that at least a portion of the light beam shaped by the optical element of the first sub-chamber travels in the particular direction. In another further embodiment, the working liquid of a given sub-chamber may be unable to pass into another sub-chamber in liquid form.

In yet still another related embodiment, the light engine may include a plurality of evaporation chambers, wherein the plurality of evaporation chambers may be connected to the condenser by the at least one connecting element. In a further related embodiment, the light engine may include a plurality of condensers, wherein each evaporation chamber in the plurality of evaporation chambers may have a corresponding condenser in the plurality of condensers.

In still yet another related embodiment, the working liquid may have a particular optical characteristic that works in combination with the optical element to beam shape the light emitted by the at least one solid state light source.

In another embodiment, there is provided a luminaire. The luminaire includes: a power source; at least one light source, wherein the at least one light source receives power from the power source; a thermosyphon light engine, including: a condenser, wherein the condenser returns a gaseous substance located therein to a liquid substance; an evaporation chamber, wherein the evaporation chamber includes: at least one solid state light source that emits light and generates heat upon activation; a working liquid into which at least a portion of the solid state light source is immersed, wherein the working liquid is capable of being changed into a gaseous substance upon the application of heat to the working liquid; and an optical element, wherein the optical element beam shapes light emitted by the at least one solid state light source; and at least one connecting element that joins the condenser to the evaporation chamber, such that when the at least one solid state light source in the evaporation chamber generates heat, a portion of the working liquid evaporates, becoming a gaseous substance, wherein the gaseous substance travels through the at least one connecting element to the condenser, and upon being returned to a liquid substance, wherein the liquid substance travels through the at least one connecting element back to the evaporation chamber; a luminaire evaporation chamber including a working liquid; and at least one luminaire connecting element; wherein the working liquid within the luminaire evaporation chamber is heated by heat generated by at least one of the power source and the at least one light source, and wherein the at least one luminaire connecting element connects the luminaire evaporation chamber with the condenser of the thermosyphon light engine.

In a related embodiment, the luminaire may include a plurality of light sources located in relation to the thermosyphon light engine, wherein the luminaire may be shaped such that the condenser and the at least one connecting element of the thermosyphon light engine, and the luminaire evaporation chamber and the at least one luminaire connecting element, are concealed from view. In a further related embodiment, a portion of the evaporation chamber of the thermosyphon light engine that includes at least a portion of the optical element may be visible in relation to the plurality of light sources.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
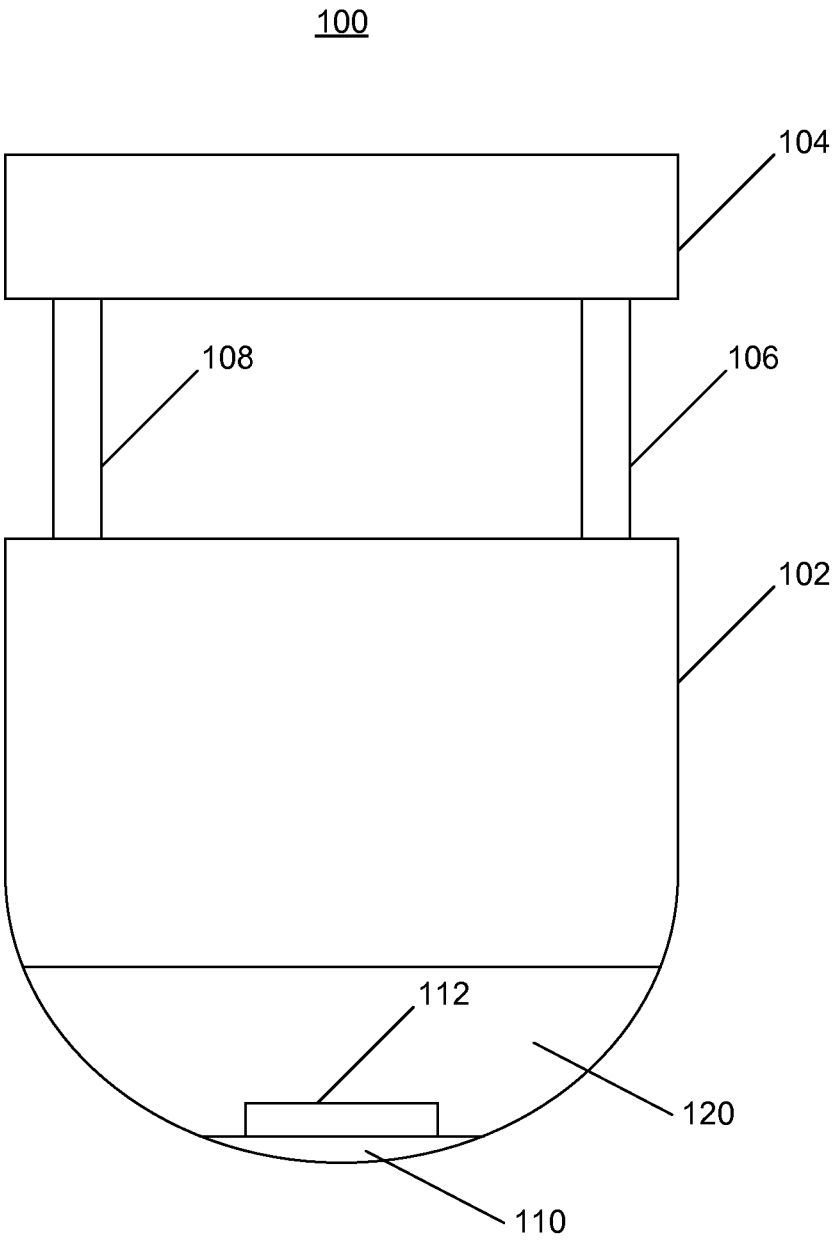
FIG. 1 shows a cross-sectional view of a thermosyphon light engine according to embodiments disclosed herein.

FIG. 1 shows a thermosyphon light engine 100. The thermosyphon light engine 100 includes an evaporation chamber 102, a condenser 104, and connecting elements 106, 108. The condenser is any device capable of receiving a gaseous substance and/or a substantially gaseous substance as an input and returning it to a liquid substance and/or a substantially liquid substance. The connecting elements 106, 108 may include, but are not limited to, tubes and/or other transmission elements or components capable of carrying a liquid and/or a suspension and/or a gas and/or a so-called "nano-fluid" and/or combinations thereof. The evaporation chamber 102 is filled with a working liquid 120. The working liquid 120 is any type of liquid, including a suspension and/or a so-called "nano-fluid", that is capable of being stored in the evaporation chamber 102 and able to cool at least one solid state light source (such as but not limited to an LED module 112 shown in FIG. 1) that is also located within the evaporation chamber 102.

The working liquid 120 within the thermosyphon in some embodiments is, but is not limited to, PF5060 manufactured by 3M®. PF5060 has a low boiling point (56° C. at normal atmospheric pressure) that is critical in maintaining the junction temperature of the at least one solid state light source as low as possible. Alternatively, or additionally, water, various alcohols, various synthetic liquids, and/or combinations of any of these, are used. Indeed, any liquid with a low boiling point (in some embodiments, 60° C. or less) is able to be used as the working liquid 120. The primary consideration in selecting a working liquid 120 depends on how low the junction temperature of the at least one solid state light source is desired to be. The junction temperature of the at least one solid state light source depends on, for example, the substrate used and/or the particular module used that incorporates the at least one solid state light source. The lower bound on the temperature of the working liquid 120 is as close to zero degrees Celsius (i.e., freezing) as possible. In some embodiments, the working liquid 120 may be frozen and then melted by the heat generated by the at least one solid state light source when the solid state light source receives power. Further, in some embodiments, the lower bound on the temperature of the working liquid 120 is substantially 30° C. to control the pressure within the thermosyphon light engine 100.

To serve as a light engine, the evaporation chamber 102 includes an optical element 110. The optical element 110 beam shapes light emitted by the at least one solid state light source located within the evaporation chamber 102. The optical element 110 may be any type of known lens, such as but not limited to a batwing lens, Fresnel lens, and the like. The optical element 110, in some embodiments, is shaped from the material comprising the evaporation chamber. Alternatively, or additionally, the optical element 110 is a separate component that is joined to the evaporation chamber 102, for example but not limited to via a recessed opening or other known connection type.

In some embodiments, it is possible to change the optical element that is used with a particular evaporation chamber 102, by removing the existing optical element and replacing it with a different optical element. In some embodiments, the optical element 110 includes a plurality of optical elements, such as but not limited to any type of lens, including combinations thereof. Though shown in FIG. 1 as occupying only a portion of an outer edge of the evaporation chamber 102, the optical element 110 may be larger such that the optical element 110 occupies the entirety of a visible edge of the evaporation chamber 102. Alternatively or additionally, in some embodiments, a plurality of optical elements (not shown in FIG. 1) occupy the entirety of the visible edge of the evaporation chamber 102.

The evaporation chamber 102 also includes at least one solid state light source, such as but not limited to the LED 112 shown in FIG. 1, as described above. The at least one solid state light source, in some embodiments, includes any of a single LED (such as the LED 112 shown in FIG. 1), an array of LEDs on a single chip, a plurality of LED chips, and combinations thereof. The at least one solid state light source is mounted on a substrate (e.g., a metal core printed circuit board, though other types of substrates may of course be used) along with appropriate electronic components that allow the at least one solid state light source to operate. The at least one solid state light source is at least partially submerged (i.e., immersed) into the working liquid 120 that fills at least a portion of the evaporator chamber 102. In some embodiments, the entirety of the at least one solid state light source is immersed. Alternatively, or additionally, only a portion of the at least one solid state light source is immersed in the working liquid 120. For example, by covering the "back side" of the at least one solid state lights source (i.e., the portion that does not include the light emitting element(s)), at least in part with the working liquid 120, heat generated by the at least one solid state light source will be dissipated. Of course, it is likely to be less heat than if the at least one solid state light source were to be totally submerged in the working liquid 120. Note that, apart from the optical element 110 of the evaporation chamber 102, in some embodiments, the at least one solid state light source may have a primary lens and/or lenses and/or reflectors (and/or combinations thereof) of its own. In some embodiments, the at least one solid state light source is sealed with a sealant, such as but not limited to DOW® Corning® 3145 RTV silicone adhesive, to provide various advantages, such as but not limited to the sealant blocking the working liquid 120 from interfering with the operation of the at least one solid state light source.

The thermosyphon light engine 100 operates as follows. When the at least one solid state light source is activated and begins to emit light, the at least one solid state light source generates heat. The heat causes the working liquid 120 within the evaporation chamber 102 to begin to increase in temperature, until the working liquid 120 begins to boil. As the working liquid 120 boils, some portion of the working liquid 120 is changed into a gaseous substance and/or a substantially gaseous substance. In other words, a portion of the working liquid 120 evaporates. The resulting gaseous substance and/or substantially gaseous substance travels through one of the connecting elements 106, 108 to the condenser 104. The condenser 104 returns the resulting gaseous substance and/or substantially gaseous substance back to a liquid substance (and/or substantially liquid substance) (i.e., the working liquid 120). The liquid substance then travels through the one of the connecting elements 106, 108 back to the evaporation chamber 102. This process runs continually so long as there is heat being generated to cause the working liquid 120 to evaporate, and so long as the evaporation chamber 102 includes enough working liquid 120 to maintain the at least one solid state light source at a particular junction temperature.

In some embodiments, the so-called "back side" of the at least one solid state light source is specially prepared to ensure that the boiling process (i.e., evaporation) begins when the at least one solid state light source receives power, is activated, and begins to generate heat. For example, in some embodiments, one or more channels and/or grooves are scored or otherwise created on the "back side". Alternatively, or additionally, a sintered material may be used. Alternatively, or additionally, the "back side" may be machine, and/or pre-machined at the time of manufacture, to include one or more grooves and/or channels. Alternatively, or additionally, in some embodiments, a secondary material that is particularly amenable to encouraging and/or enhancing the boiling process may be added. Any additions and/or alterations to the at least one solid state light source that enhance the boiling process (i.e., evaporation) assist in the maintenance of the cooling process performed by the thermosyphon.

In some embodiments, as shown in FIG. 1, the optical element 110 and the at least one solid state light source (i.e. the LED 112) are correspondingly shaped, so that the at least one solid state light source rests adjacent to the optical element 110 on an interior surface of the evaporation chamber 102. This allows the light emitted by the at least one solid state light source to be more directly beam shaped by the optical element 110 without interference from the working liquid 120. Alternatively, in some embodiments, the working liquid 120 may be chosen because it exhibits one or more particular optical characteristics. Such an optical characteristic and/or characteristics may be particularly chosen to interact with the optical element 110 in a desired way. Thus, for example, the working liquid 120 may be, in some embodiments, clear, substantially clear (i.e., translucent), and/or substantially opaque. As another example, the working liquid 120 may have a particular color and/or a known or measurable refractive index.

Figure 2:
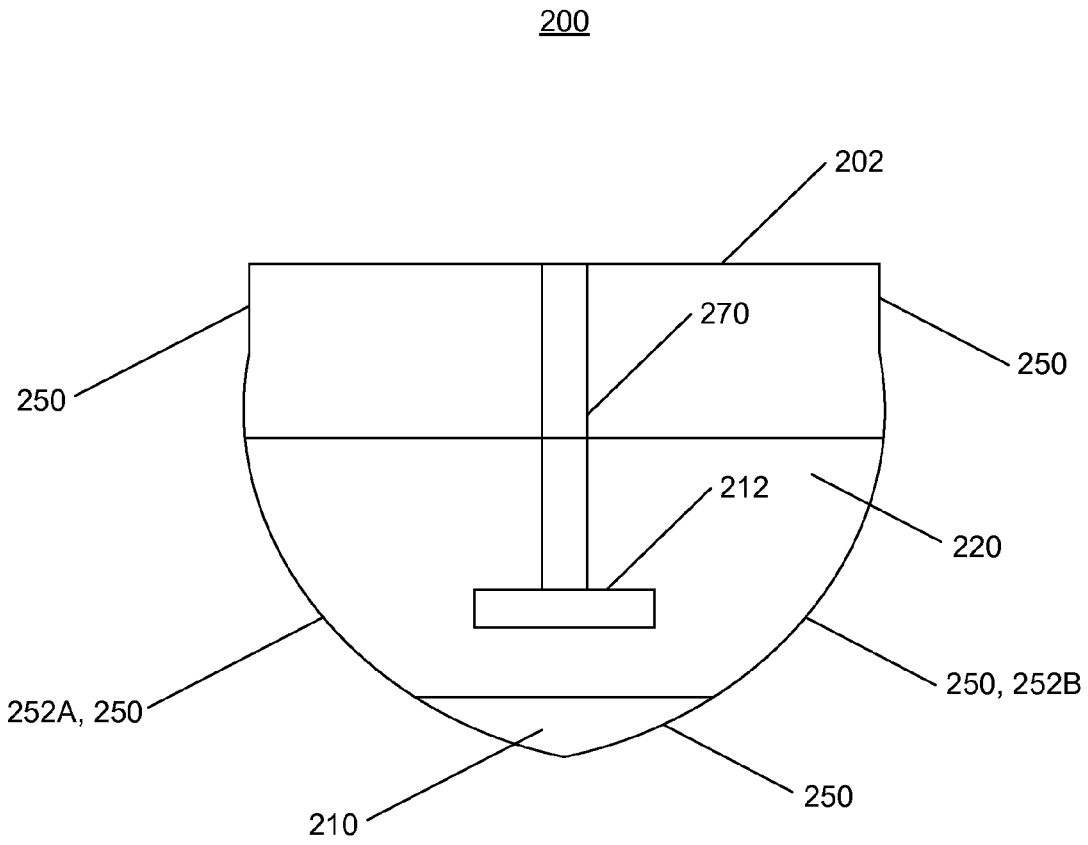
FIG. 2 shows a cross-sectional view of a thermosyphon light engine having an evaporation chamber shaped to assist the optical element thereof, according to embodiments disclosed herein.

FIG. 2 shows a cross-sectional view of a portion 200 of an evaporation chamber 202 of a thermosyphon light engine. In FIG. 2, the evaporation chamber 202 has an exterior wall 250. The optical element 210 is formed in a first portion of the exterior wall 250. A second portion 252A, 252B of the exterior wall 250 is shaped so as to enhance the directional effects of the optical element 210. For example, the second portion 252A, 252B are shaped so as to collimate light generated by an LED 212 in addition to the beam shaping performed by the optical element 210. The second portion 252A, 252B (and thus the exterior wall 250) of the evaporation chamber 202 may be shaped in any way to achieve one or more particular optical effects, either alone or in combination with the optical element 210. Alternatively, or additionally, the second portion 252A, 252B, in some embodiments, is made of a reflective element and/or coated with a reflective coating to help direct light to the optical element 210.

Thus, in some embodiments, the evaporation chamber 202 is made from a particular material and/or materials. For example, the evaporation chamber 202 may be made from a material that is clear (i.e., transparent), or translucent, or in some embodiments perhaps even substantially opaque. Whatever material is used should allow light to exit the evaporation chamber 202 through at least the optical element 210. The evaporation chamber 202, in some embodiments, is made entirely of one material (for example but not limited to plastic), and other embodiments, is partially made from a first material and partially made from one or more other materials (e.g., the side walls (i.e., second portion 252A, 252B) could be reflective materials, or a metallized plastic, etc.).

The evaporation chamber 202, in some embodiments, itself is modular, such that it would be possible to swap out one kind and/or shape of evaporation chamber for another. In such embodiments, it is important to have a good seal between the evaporation chamber 202 and any connecting elements (such as connecting elements 106, 108 shown in FIG. 1). Further, in some embodiments, the evaporation chamber 202 may be of any shape or size, so long as it is capable of holding the at least one solid state light source and the working liquid.

FIG. 2 also shows a support element 270. The support element 270 holds the at least one solid state light source (i.e., the LED 212) in a particular position within the evaporation chamber 202. The support element 270 is particularly useful when the evaporation chamber 202 is not located in a direction leads to gravity keeping the at least one solid state light source and/or working liquid 220 in contact with each other. Thus, in some embodiments, the support element 270 holds the at least one solid state light source in a particular position within the evaporation chamber 202 when the at least one solid state light source is immersed within the working liquid 220.

Figure 3:
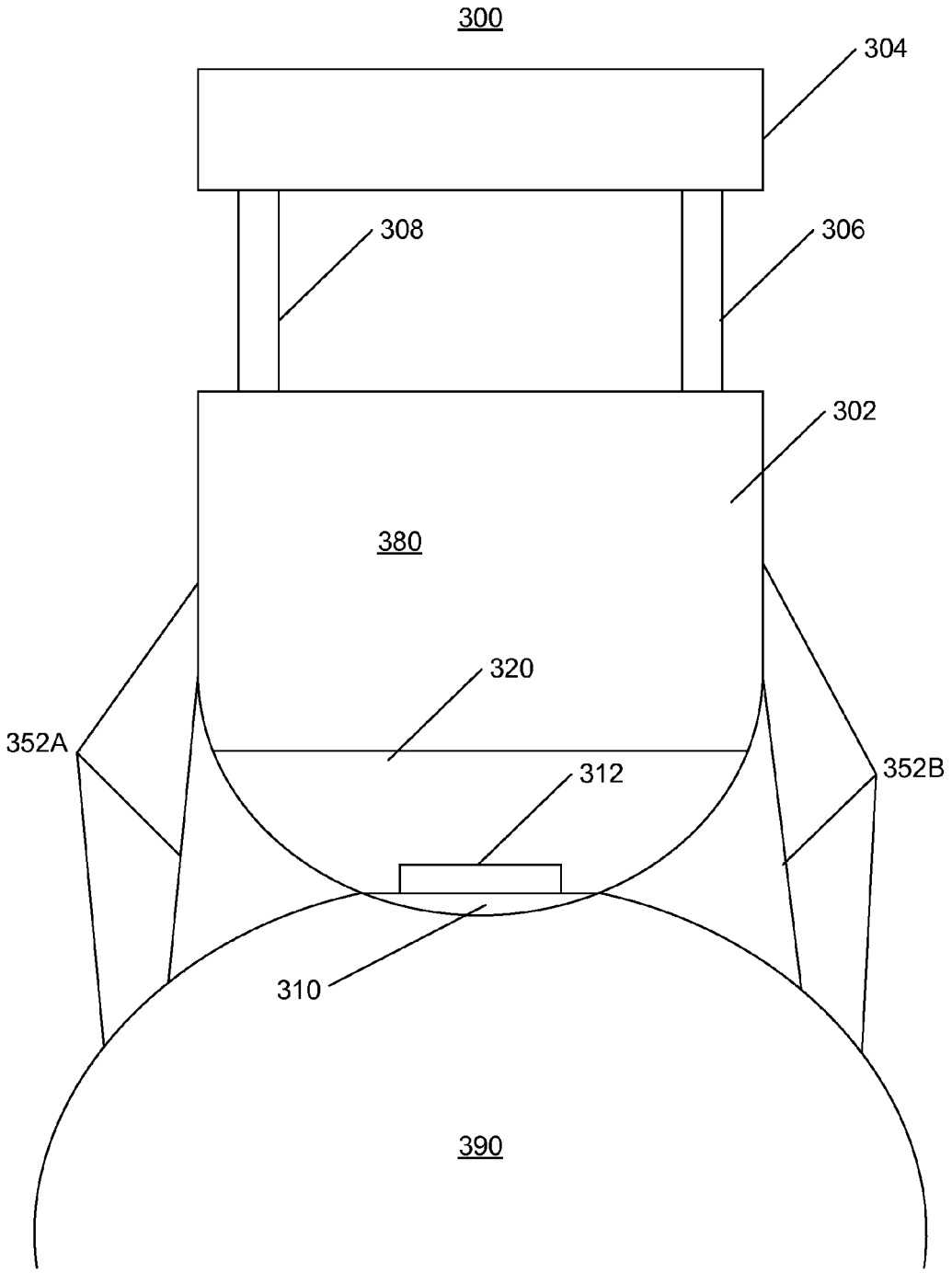
FIG. 3 shows a cross-sectional view of a thermosyphon light engine including a reflector shaped as part of an evaporation chamber, according to embodiments disclosed herein.

FIG. 3 shows a thermosyphon light engine 300 where side walls 352A, 352B of an evaporation chamber 302 are shaped so as to extend beyond an optical element 310. The side walls 352A, 352B, in some embodiments, serve as reflectors (i.e., mechanical and optical cutoffs for the light emitted through the optical element 310). More specifically, the evaporation chamber 302 includes an inner portion 380 and an outer portion 390. The inner portion 380 includes at least one solid state light source 312, the working liquid 320, and the optical element 310. The outer portion 390 includes the extended side walls 352A, 352B.

Figure 4:
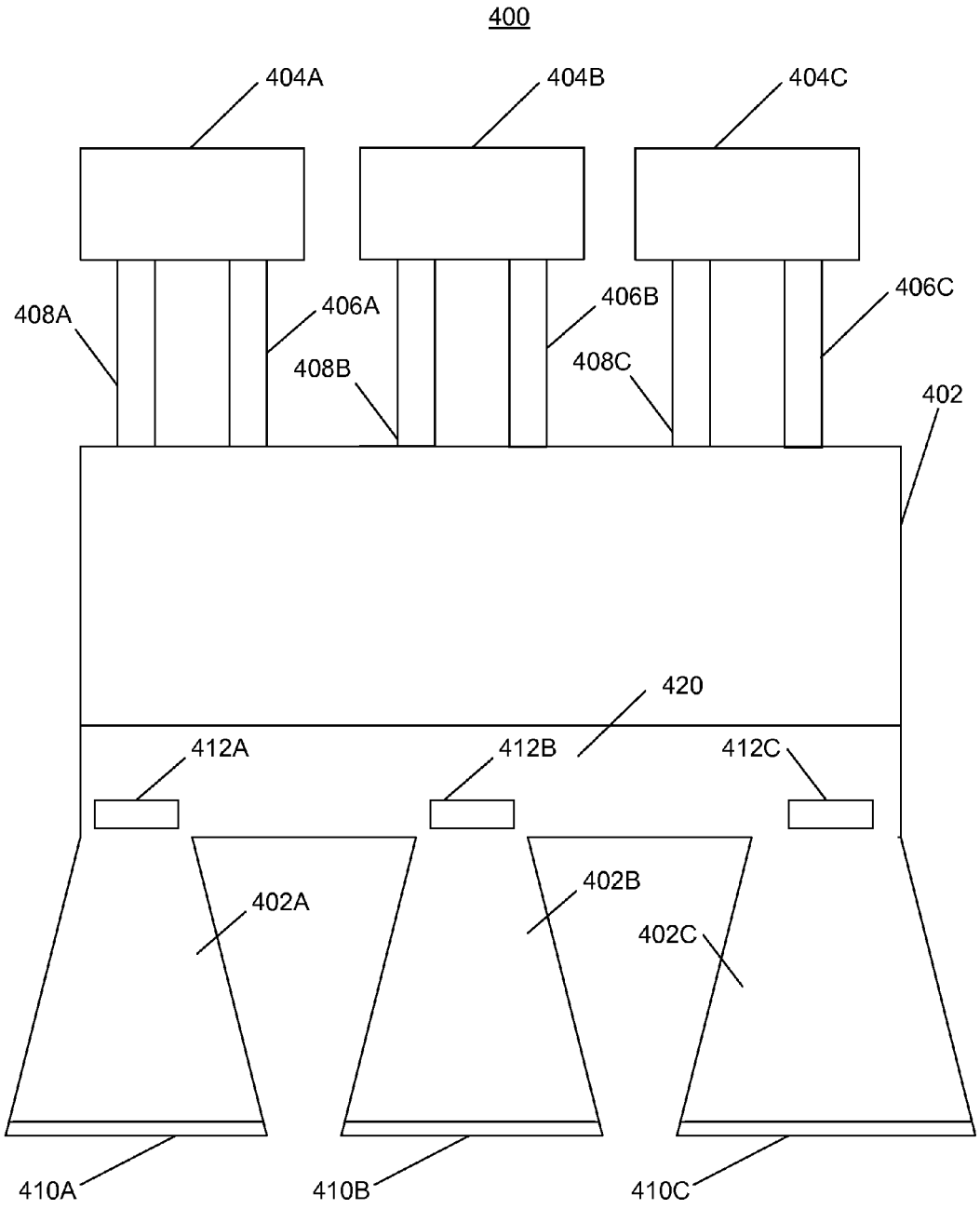
FIG. 4 shows a cross-sectional view of a thermosyphon light engine including a plurality of sub-chambers, according to embodiments disclosed herein.
Figure 5:
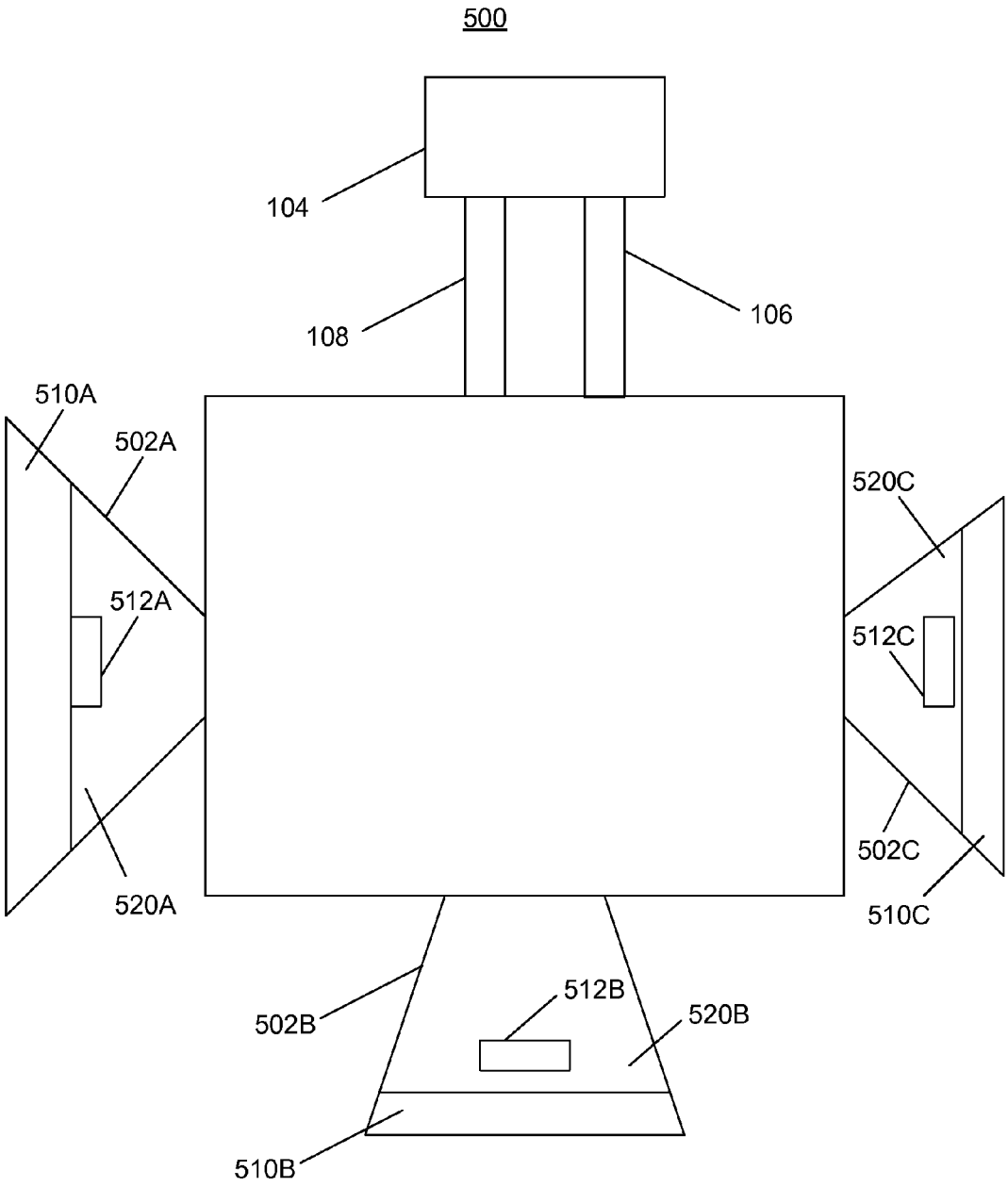
FIG. 5 shows a cross-sectional view of a thermosyphon light engine including a plurality of directed sub-chambers, according to embodiments disclosed herein.

FIGS. 4 and 5 show cross-sectional views of thermosyphon light engines 400 and 500, respectively, that include more than one evaporation chamber and/or a plurality of sub-chambers. In FIG. 4, the thermosyphon light engine 400 includes three sub-chambers 402A, 402B, and 402C that are all part of an evaporation chamber 402. Each sub-chamber 402A, 402B, and 402C includes a solid state light source 412A, 412B, and 412C, a working liquid 420, and an optical element 410A, 410B, and 410C. In some embodiments, each sub-chamber 402A, 402B, and 402C may include its own working liquid (as shown in FIG. 5). In some such embodiments, the working liquid of a given sub-chamber is unable to pass into another sub-chamber in liquid form. Of course, the gaseous form of the working liquid may, and in some embodiments, is, able to pass from one sub-chamber into another.

In some embodiments, each sub-chamber 402A, 402B, and 402C in the plurality of sub-chambers are of the same and/or substantially the same shape. Alternatively, or additionally, as shown in FIG. 4, each sub-chamber 402A, 402B, and 402C in the plurality of sub-chambers is shaped to achieve a particular optical effect in combination with the optical element of that particular sub-chamber. Alternatively, or additionally, some subset of the plurality of sub-chambers may each have a first shape, while some other subset of the plurality of sub-chambers have a second shape, where the first shape is different from the second shape. Endless combinations of differently shaped sub-chambers are possible. Of course, each sub-chamber may also have other distinctive characteristics, such as those described in relation to any evaporation chamber described herein.

As shown in FIG. 4, for each sub-chamber 402A, 402B, and 402C there is a condenser 404A, 404B, and 404C. A sub-chamber, in some embodiments, is matched to a particular condenser, such that the sub-chamber is itself considered to be an evaporation chamber, and each sub-chamber thus has a corresponding condenser. A sub-chamber/chamber and a condenser are connected by a connecting element (i.e., one of connecting elements 406A, 406B, 406C, 408A, 408B, and/or 408C).

In some embodiments, the ratio between condensers and solid state light sources (i.e., what is being cooled) may be one to one, and the ratio may be the same between evaporation chambers and what is being cooled. That is, for a single LED module, some embodiments may use a single condenser and a single evaporation chamber. Similarly, for a single LED array, some embodiments may use a single condenser and a single evaporation chamber. Further, in other embodiments, where a number of luminaires including thermosyphon light engine(s) are in a location (e.g., a room), and where each luminaire includes its own LED array/module, the ratio between luminaires and condensers/evaporation chambers may again be 1:1. However, in other embodiments, a higher ratio of light source/elements containing light sources to thermosyphon components may be used.

The thermosyphon light engine 500 shown in FIG. 5 also includes a plurality of evaporation chambers 502A, 502B, and 502C (which may also be referred to as sub-chambers). However, here each evaporation chamber 502A, 502B, and 502C are fixed in different directions. That is, the evaporation chamber 502A is fixed in a direction opposite the a direction of the evaporation chamber 502C, while the evaporation chamber 502B is fixed in a direction that is perpendicular to the direction of either the evaporation chamber 502A or the evaporation chamber 502C. By fixing the direction of one or more evaporation chambers in this way, it is possible to further guide light emitted by at least one solid state light source contained therein, through the optical element of that evaporation chamber, in a particular direction. This gives a lighting designer looking to use a thermosyphon light engine, either as a lighting module on its own or as part of a luminaire, a great deal of flexibility, while providing the same optical and thermal advantages.

Each evaporation chamber 502A, 502B, and 502C as shown in FIG. 5 include their own respective working liquid 520A, 520B, and 520C, as well as their own respective solid state light source 512A, 512B, and 512C, and respective optical element 510A, 510B, and 510C. Each evaporation chamber 502A, 502B, and 502C is able to be configured differently, or similarly, or the same as any other evaporation chamber. For example, the solid state light source 512A is adapted to sit directly adjacent to the optical element 510A in the evaporation chamber 502A. The optical element 512B is of a different size than the optical element 510A. The evaporation chamber 502C itself is of a different shape that the evaporation chamber 502B. All of the evaporation chambers 502A, 502B, and 502C are served by the same condenser 504 and connecting elements 506 and 508.

Figure 6:
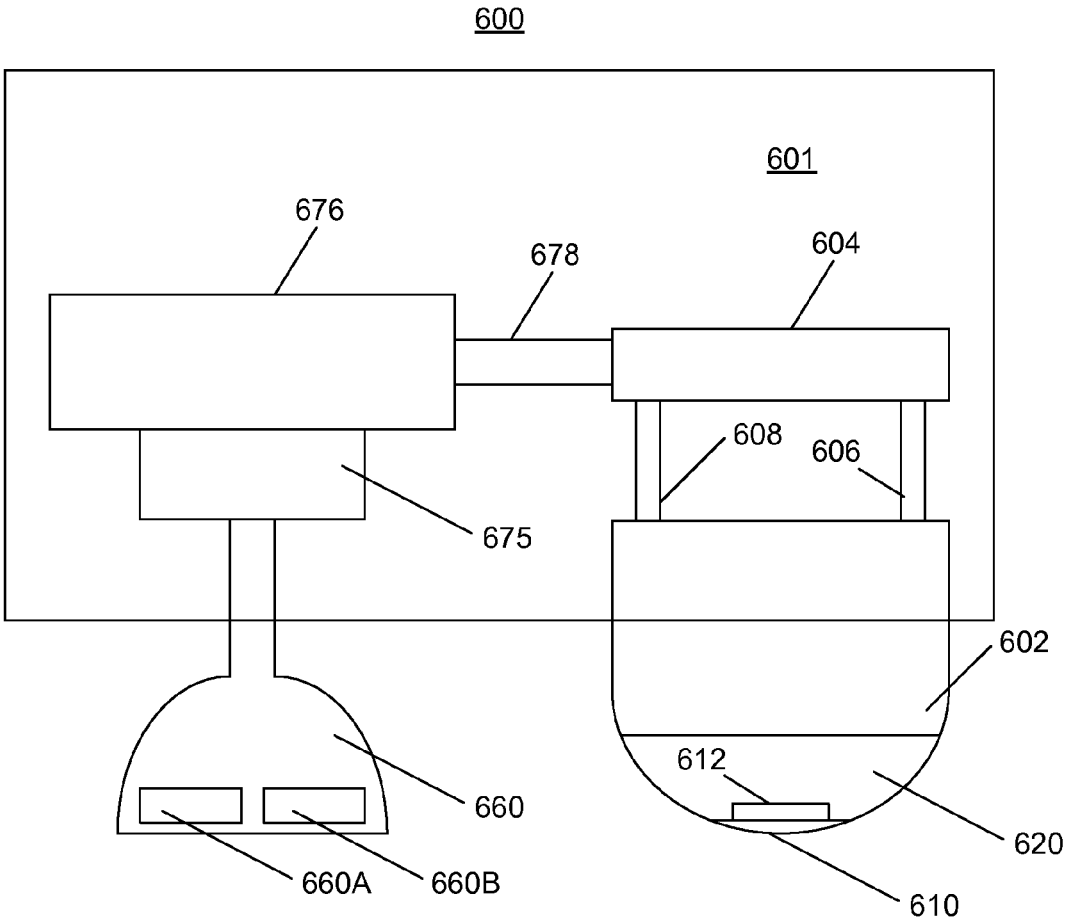
FIG. 6 shows a cross-sectional view of a luminaire incorporating a thermosyphon light engine, according to embodiments disclosed herein.

FIG. 6 shows a luminaire 600 including a thermosyphon light engine 601 as well as at least one n additional light source 660. The at least one additional light source 660 may be a conventional light source (i.e., an incandescent, fluorescent, and/or halogen lamp and/or luminaire include such a lamp), or may be a solid state light source (either a lamp and/or a retrofit lamp, and/or a luminaire including such a lamp and/or retrofit lamp). The at least one additional light source 660 includes at least one, and in some embodiments, a plurality of, light sources 660A, 660B. The luminaire 600 also includes a power source 675. The power source provides power to at least one additional light source 660. Thus, the at least one additional light source 660 receives power from the power source 675. The thermosyphon light engine 601 includes a condenser 604, an evaporation chamber 602, and connecting elements 606 and 608, all as described herein. Thus, the evaporation chamber 602 includes at least one solid state light source 612, a working liquid 620, and an optical element 610, all as described herein. The luminaire additionally includes a luminaire evaporation chamber 676, which itself including a working liquid 677, and at least one luminaire connecting element 678. The at least one luminaire connecting element 678 connects the luminaire evaporation chamber 676 to the condenser 604 of the thermosyphon light engine 601. When the working liquid 677 within the luminaire evaporation chamber 676 is heated by heat generated by at least one of the power source 675 and the at least one additional light source 660, the working liquid 677 begins to evaporate into a gaseous substance, which travels through the at least one luminaire connecting element 678 to the condenser 604. The condenser 604 returns the gaseous substance to a liquid form, which travels back to the luminaire evaporation chamber 676 via the at least one luminaire connecting element 678. Of course, in some embodiments, the luminaire evaporation chamber 676 has its own condenser (not shown in FIG. 6) that is separate from the condenser of the thermosyphon light engine 601. Alternatively, or additionally, in some embodiments, a plurality of luminaires and/or components thereof may share one or more condensers via a plurality of connecting elements. The plurality of light sources 660A, 660B are located in relation to the thermosyphon light engine 601. The luminaire 600 is shaped such that the condenser 604 and the connecting elements 606, 608 of the thermosyphon light engine 601, and the luminaire evaporation chamber 676 and the at least one luminaire connecting element 678, are concealed from view. For example, these may be sealed in a housing, such as the housing 679 shown in FIG. 6. A portion of the evaporation chamber 602 of the thermosyphon light engine 601 that includes at least a portion of the optical element 610 is visible in relation to the plurality of light sources 660A, 660B. In some embodiments (not shown in FIG. 6), the at least one additional light source 660 is located at least partially within the luminaire evaporation chamber 676, and the luminaire evaporation chamber 676 includes its own optical element that beam shapes light emitted by the at least one additional light source 660.

When placed into a luminaire, a thermosyphon light engine as described herein may be used as a general illumination source or as accent lighting, or in combinations thereof. This may be done by directly shaping a surface of the luminaire to include one or more protruding thermosyphon light engines. The thermosyphon light engine may also provide cooling to the solid state lighting elements and/or other lighting elements and/or power supply(ies) and/or other heat-generating components associated with the luminaire. In a preferred embodiment, a luminaire is mounted in a ceiling, or otherwise attached thereto, including one or more light sources and one or more thermosyphon light engines. One or more of the light sources may be separate from the one or more thermosyphon light engines, such that the one or more thermosyphon light engines serve as separate light-generating elements from the one or more light sources. For example, the light sources may be a number of pendant fixtures attached to a ceiling tile, which in total is considered to be a luminaire, and the one or more thermosyphon light engines may be embedded within the ceiling tile, and may serve as a general illumination source (along with the pendant fixtures) or as accent lighting. Alternatively, or additionally, the light sources and the thermosyphon light engines may be combined together, such that the thermosyphon light engines include the light sources, and the only source of illumination from the luminaire is the one or more thermosyphon light engines.

Further, the luminaire may receive power in any known way, such as but not limited to via a power source and/or a power supply, whether transmitted to the luminaire via wire or wirelessly, as is known in the art. When the power source, power supply, and/or transmission element(s) is located in some proximity to the luminaire, the power source, power supply, and/or transmission element may be, and in some embodiments, is/are, cooled using a thermosyphon (i.e., evaporation chamber, condenser, and connecting element(s)), either separate from the one or more thermosyphon light engines or otherwise connected thereto.

Alternatively, in some embodiments, instead of the luminaire being a ceiling tile with a number of pendant fixtures and thermosyphon light engines attached thereto, the luminaire itself may include both a traditional luminaire (e.g., a fixture including one or more light sources) and one or more thermosyphon light engines. For example, the luminaire may be a ceiling-mounted fixture, such as but not limited to a flush mounted fixture, where the optical element facing down includes one or more thermosyphon light engines. In some embodiments, the luminaire may be wall mounted instead of ceiling mounted, and the thermosyphon light engines are designed such that the working liquid(s) contained therein remain around the light sources contained therein.

Unless otherwise stated, use of the word "substantial" and/or "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A light engine comprising:

a condenser, wherein the condenser returns a gaseous substance located therein to a liquid substance;

an evaporation chamber, wherein the evaporation chamber includes:

at least one solid state light source that emits light and generates heat upon activation;

a working liquid into which at least a portion of the solid state light source is immersed, wherein the working liquid is capable of being changed into a gaseous substance upon the application of heat to the working liquid; and an optical element, wherein the optical element beam shapes light emitted by the at least one solid state light source; and at least one connecting element that joins the condenser to the evaporation chamber, such that when the at least one solid state light source in the evaporation chamber generates heat, a portion of the working liquid evaporates, becoming a gaseous substance, wherein the gaseous substance travels through the at least one connecting element to the condenser, and upon being returned to a liquid substance, wherein the liquid substance travels through the at least one connecting element back to the evaporation chamber.

2. The light engine of claim 1, wherein the optical element and the at least one solid state light source are correspondingly shaped so that the at least one solid state light source rests adjacent to the optical element on an interior surface of the evaporation chamber.

3. The light engine of claim 1, wherein the evaporation chamber further comprises:

a support element, wherein the support element holds the at least one solid state light source in a particular position within the evaporation chamber.

4. The light engine of claim 3, wherein the support element holds the at least one solid state light source in a particular position within the evaporation chamber when the at least one solid state light source is immersed within the working liquid.

5. The light engine of claim 1, wherein the evaporation chamber includes a wall, the wall having a first portion and a second portion, wherein the optical element is formed in the first portion of the wall, and wherein the second portion of the wall is shaped such that light passing through the optical element is further beam shaped by the second portion.

6. The light engine of claim 1, wherein the evaporation chamber is shaped to include an interior portion and an exterior portion, wherein the interior portion comprises the at least one solid state light source, the working liquid, and the optical element, and wherein the exterior portion comprises a reflector.

7. The light engine of claim 1, wherein the evaporation chamber comprises a plurality of sub-chambers, wherein each sub-chamber in the plurality of sub-chambers includes a solid state light source, a working liquid, and an optical element.

8. The light engine of claim 7, wherein each sub-chamber in the plurality of sub-chambers is shaped to achieve a particular optical effect in combination with the optical element of that sub-chamber.

9. The light engine of claim 7, wherein a first sub-chamber in the plurality of sub-chambers is fixed in a particular direction relative to a second sub-chamber in the plurality of sub-chambers, such that at least a portion of the light beam shaped by the optical element of the first sub-chamber travels in the particular direction.

10. The light engine of claim 7, wherein the working liquid of a given sub-chamber is unable to pass into another sub-chamber in liquid form.

11. The light engine of claim 1, comprising a plurality of evaporation chambers, wherein the plurality of evaporation chambers are connected to the condenser by the at least one connecting element.

12. The light engine of claim 11, comprising a plurality of condensers, wherein each evaporation chamber in the plurality of evaporation chambers has a corresponding condenser in the plurality of condensers.

13. The light engine of claim 1, wherein the working liquid has a particular optical characteristic that works in combination with the optical element to beam shape the light emitted by the at least one solid state light source.

14. A luminaire comprising:

a power source;

at least one light source, wherein the at least one light source receives power from the power source;

a thermosyphon light engine, comprising:

a condenser, wherein the condenser returns a gaseous substance located therein to a liquid substance;

an evaporation chamber, wherein the evaporation chamber includes:

at least one solid state light source that emits light and generates heat upon activation;

a working liquid into which at least a portion of the solid state light source is immersed, wherein the working liquid is capable of being changed into a gaseous substance upon the application of heat to the working liquid; and an optical element, wherein the optical element beam shapes light emitted by the at least one solid state light source; and at least one connecting element that joins the condenser to the evaporation chamber, such that when the at least one solid state light source in the evaporation chamber generates heat, a portion of the working liquid evaporates, becoming a gaseous substance, wherein the gaseous substance travels through the at least one connecting element to the condenser, and upon being returned to a liquid substance, wherein the liquid substance travels through the at least one connecting element back to the evaporation chamber;

a luminaire evaporation chamber including a working liquid; and at least one luminaire connecting element;

wherein the working liquid within the luminaire evaporation chamber is heated by heat generated by at least one of the power source and the at least one light source, and wherein the at least one luminaire connecting element connects the luminaire evaporation chamber with the condenser of the thermosyphon light engine.

15. The luminaire of claim 14, comprising a plurality of light sources located in relation to the thermosyphon light engine, wherein the luminaire is shaped such that the condenser and the at least one connecting element of the thermosyphon light engine, and the luminaire evaporation chamber and the at least one luminaire connecting element, are concealed from a view of a user receiving light from the plurality of light sources.

16. The luminaire of claim 15, wherein a portion of the evaporation chamber of the thermosyphon light engine that includes at least a portion of the optical element is visible in relation to the plurality of light sources.

* * * * *